United States Patent [19]

Gong

[11] Patent Number: 4,910,647

[45] Date of Patent: Mar. 20, 1990

[54] FLOWER LAMP

[76] Inventor: Zuxiang Gong, 150 South Russell St., City of Industry, Calif. 91744

[21] Appl. No.: 323,326

[22] Filed: Mar. 14, 1989

[51] Int. Cl.[4] ..... F21P 1/02

[52] U.S. Cl. ..... 362/122; 362/283; 362/284; 362/272

[58] Field of Search ..... 362/122, 282, 283, 284, 362/253, 255, 271, 272, 324

[56] References Cited

U.S. PATENT DOCUMENTS 4,399,493 8/1983 Kurita et al. ..... 362/122

FOREIGN PATENT DOCUMENTS 1115071 4/1956 France ..... 362/122

*Primary Examiner*—Carroll B. Dority

*Attorney, Agent, or Firm*—J. Harrison Colter

[57] ABSTRACT

A lamp includes a bulb that is held within an openable housing. When the lamp is turned on, the bulb gradually lights and the housing gradually opens to expose the bulb. When the lamp is turned off, the housing closes around and thereby conceals the bulb. Methods for opening the housing include a sliding piston system, a cam and lifter system and a gear and rack system. When the lamp is turned on or off, music may also be played or other such sounds generated.

16 Claims, 2 Drawing Sheets

FLOWER LAMP

BACKGROUND OF THE INVENTION

This invention relates to a lamp having a housing that encloses the bulb when the lamp is off and opens to reveal the bulb hen the lamp is turned on.

Lamps and other light fixtures are used for interior decoration as well as providing light. Typical lamps have lampshades, chandeliers or other such fixtures around the lightbulbs to beautify the lamp because typical lightbulbs are not asthetically pleasing. As a result, numerous different lampshades and other decorative items have been developed to, in effect, conceal or otherwise surround the unsightly bulb for aesthetic purposes. In most cases, however, the lampshade or surrounding fixtures are variations of the same basic themes; that is, a lampshade, a chandelier, or a transparent, semi-transparent or translucent fixed covering over or around the bulb.

SUMMARY OF THE INVENTION

The present invention provides a lamp that has a lightbulb surrounded by decorative features with the bulb held in an openable and closable housing so that when the lamp is turned on, the housing opens to reveal the bulb and when the lamp is turned off, the housing closes. The lamp may be inexpensively manufactured using one of several reliable, trouble-free constructions depending on the intended use. The lamp can be made using many different decorative themes such as flowers with petals that open to reveal the bulb, animal mouths that open to reveal the bulb or automobile hoods that open to reveal the bulb.

More specifically, a lamp constructed in accordance with the present invention is preferably set in decorative surroundings with electrical connections to the bulb. When the bulb is off, the housing surrounds and conceals the bulb. When the lamp is turned on, the housing opens and electricity is provided to the bulb, preferably in a gradual way so that as the housing gradually opens, the light from the bulb gradually intensifies. When the lamp is then turned off, the housing gradually closes to again surround and conceal the bulb and, preferably, the electricity to the bulb gradually decreases and the bulb gradually dims. If desired, the lamp may include a speaker and an accoustical integrated circuit to generate a short sound such as a musical piece or, in the case of an animal being used as the lamp, a growl or the like, when the lamp is turned on and off.

BRIEF DESCRIPTION OF THE DRAWINGS

Other features and advantages of the invention will be apparent from the following Detailed Description taken in conjunction with the accompanying drawings, in which:

FIG. 2 is a perspective view of the lamp of FIG. 1 with the light turned on;

DETAILED DESCRIPTION

Figure 1:
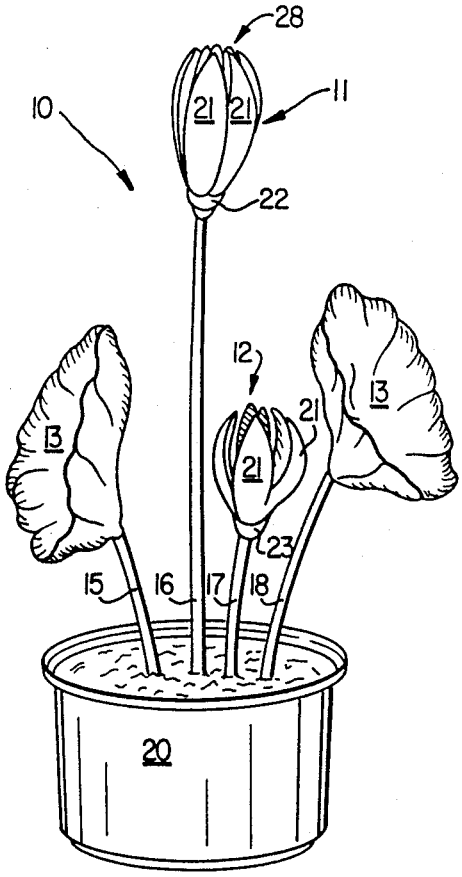
FIG. 1 is a perspective view of one embodiment of the lamp of the present invention with the light turned off.
Figure 2:
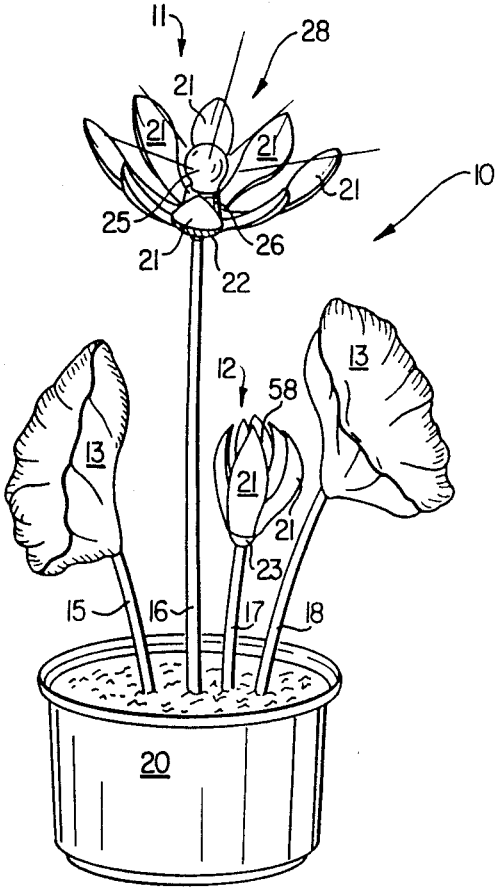

As shown in the drawings for purposes of illustration, the invention is embodied in a decorative lamp 10 that is held in an aesthetically pleasing environment. The any of a number of different surroundings may be used with the lamp but a flower pot is used in the drawings to illustrate the invention. As shown in FIGS. 1 and 2, the flower pot environment of the lamp includes artificial flowers 11 and 12 and reinform leaves 13 mounted by stems 15, 16, 17 and 18 to a base 20. Each of the flowers is formed from petals 21 attached around collars 22 and 23 that are attached to the base by the stems 16 and 17. A bulb 25 is held in a socket 6 attached to the collar 22 that forms the taller flower 11. The lamp may be activated by a wall switch or may employ an accoustical switch that responds to sound such as a hand clap. The electrical and mechanical components of the present invention are concealed within the base and the artificial plant parts.

As is evident from comparing FIGS. 1 and 2, according to the present invention the petals 21 forming the taller flower 11 define a housing 28 that contains the bulb 25. When the lamp 10 is off, the petals close around the bulb as depicted in FIG. 1. When the lamp is turned on, the petals gradually open to expose the bulb as shown in FIG. 2 and the bulb lights. Because the petals do not instantaneously open, the light from the bulb may be gradually intensified to correspond with the gradual opening of the housing, thereby increasing the aesthetic appeal of the lamp. Thus, the petals open and the light from the bulb intensifies in a coordinated fashion. The lamp incorporates the motion of the petals to make the lamp more interesting and attractive. The result is an aesthetically pleasing lamp that conceals the bulb when off and yet beautifies the surroundings of the bulb when on without significantly reducing the light coming from the bulb.

Several different simple mechanical systems may be employed to open the petals 21. In the system depicted in FIG. 3, a small electric motor 30 drives a screw 31 to cause a piston 32 to move up or down depending on whether the lamp is being turned on or off. A shaft 33 is attached to the top of the piston and wires 34 connect the shaft to the individual petals 21. When the lamp 25 is turned on, the motor is activated to turn the screw in one direction and thereby drive the piston and the shaft 33 connected to the piston upward. The upward movement of the shaft reduces the tension on the wires and, because of the weight of the petals, the petals pivot about small pins 35 that hold the petals to the collar 22 attached to the stem 16 of the flower 11. The result is that the petals gradually open to expose the bulb 25. When the lamp is turned off, the motor rotates the screw in the opposite direction to draw the piston down on the screw and thereby pull the shaft and the wires attached to the petals. The tension in the wires causes the petals to pivot about the pins to close the petals around the bulb.

Figure 4:
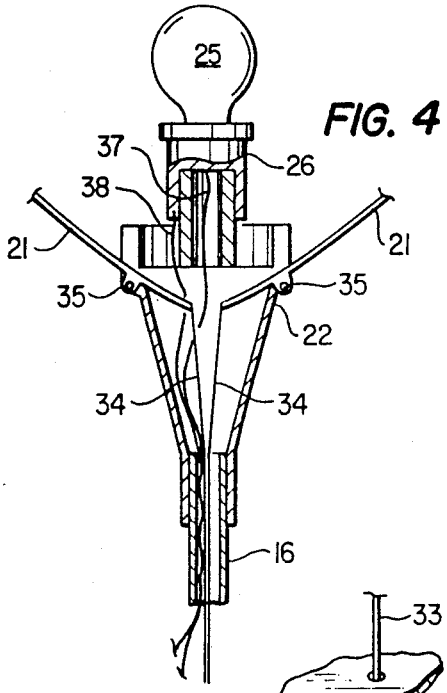
FIG. 4 is a partial cross-sectional view of the lamp of FIG. 1 showing the housing opened.

As shown in FIG. 4, a first electrical lead 37 and a second electrical lead 38 provide electricity to the socket 26 to power the bulb 25. The first and second leads extend through the collar 22 and down the stem 16 into the base 20 and are then connected to the lamp circuitry.

Figure 3:
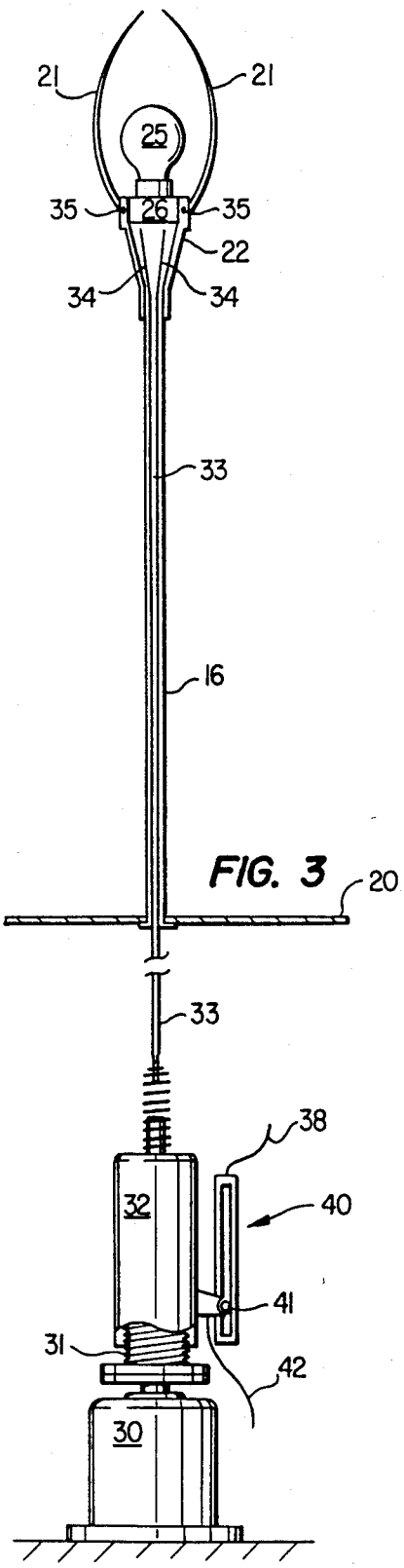
FIG. 3 is a cross-sectional view of the lamp of FIG. 1 showing one system for opening and closing the housing.

As depicted in FIG. 3, a variable resistor 40 may be attached to the piston 32 to provide a "dimming" feature to the lamp 10. Specifically, the variable resistor 40 is attached to the second lead 38. When the piston is driven up, contact 41 is driven up the variable resistor thereby reducing the resistance between the second lead 38 and a third electrical lead 42 that is attached to the contact. As a result of the reduction in resistance, the light from the bulb 25 gradually intensifies. Likewise, when the shaft 33 is driven down to close the petals 21 about the bulb, the contact 41 moves down the variable resistor thereby increasing the resistance between the second and third leads and gradually dimming the bulb. Capacitors may be used to provide power to the motor 30 and the dimming bulb 25 after the wall switch has been turned off so that the bulb may gradually dim as the motor slowly closes the petals.

Figure 5:
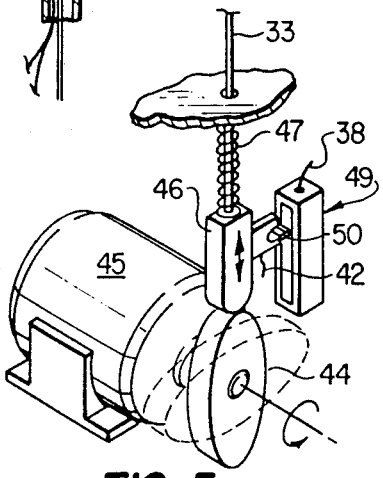
FIG. 5 is a perspective view of a portion of a second system for opening and closing the housing.
Figure 6:
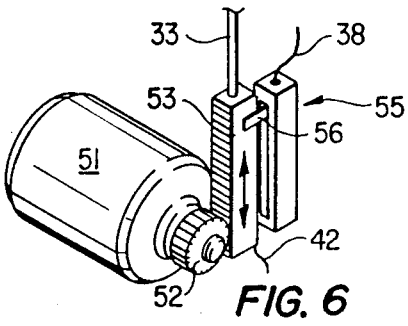
FIG. 6 is a perspective view of a portion of a third system for opening and closing the housing.

FIGS. 5 and 6 depict alternate systems for driving the shaft 33 in the stem 16 up or down. In the embodiment depicted in FIG. 5, an elipsoid cam 44 is mounted on the output of a motor 45. When the lamp is turned on, the motor rotates the cam 90° as indicated by the dashed lines in FIG. 5. Rotation of the cam drives a lifter 46 that is connected to the end of the shaft 33. Forcing the lifter upward also pushes the shaft 33 upward and relieves the tension on the wires 34 at the end of the shaft and so the petals pivot open as described above. When the lamp is turned off, the motor rotates the elipsoid cam another 90° add the lifter is lowered under the influence of a spring 47, thereby increasing the tension in the wires to pull the petals around the bulb. Again, a variable resistor 49 may be connected between the second lead 38 and the third lead 42 by attaching a contact 50 to the lifter to provide gradual intensifying and dimming of the bulb when the lamp is turned on or off, respectively.

As depicted in FIG. 6, a gear and rack system may also be used to pen or close the petals. Specifically, a motor 51 rotates a gear 52 to drive a rack 53 up or down. Driving the rack upwardly as depicted in FIG. 6 opens the petals and driving the rack downwardly from the position indicated in FI.. 6 closes the petals in the same manner as discussed. Again, a variable resistor 55 may be connected between the second lead 38 and a contact 56 and the third lead 42 to gradually intensify or dim the bulb.

The sliding piston system shown in FIG. 3 is good for lamps having a large base 20. The elipsoid cam and lifter system shown in FIG. 5 is useful if the base is smaller and is particularly useful when using a variable resistor that is not attached to the lifter such as is known in the art. The gear and rack system is particularly good for a lamp having a small base.

In addition to the visual aspects of the opening housing, a speaker 58 may be mounted in the second flower 12 or in the base 20 so that hen the lamp is turned on or off, a signal passes through an acoustic integrated circuit to generage a desired musical interlude from the speaker. Preferably, the music plays for approximately the same time as it takes to open or close the petals.

According to one embodiment of the invention, the circuitry is designed so that when the lamp is turned on such as by flipping a wall switch or by activating an acoustic switch, the bulb 25 gradually intensifies over a period of thirty seconds. At the same time, an acoustical integrated circuit plays a thirty second "welcome guest" tune and the motor 30 turns the screw 31 for thirty seconds to open the petals 21. When the wall switch is turned off or the acoustical switch is again activated, the variable resistor gradually dims the light and second acoustical integrated circuit plays a thirty second "goodbye guest" tune. The motor rotates in the opposite direction to close the petals.

Figure 7:
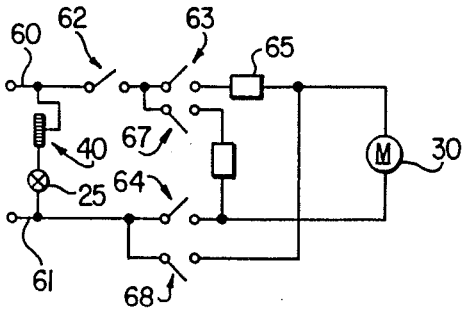
FIG. 7 is a schematic view of a portion of the circuitry used in one embodiment of the lamp of FIG. 1.

Suggested circuitry for this embodiment is shown in FIG. 7. A first lead 60 is connected to the variable resistor 40, through to the bulb 25 and to a return lead 61. The circuitry utilizes direct current and hence the motor 30 in this embodiment is a d.c. motor. Upon activation of the lamp 11 such as by flipping the wall switch or activating the acoustic switch, a first timed switch 62 closes for thirty seconds as does a first pair of timed switches 63 and 64. This drives the motor 30 in a specific direction, for instance, clockwise, and also causes an acoustical integrated circuit 65 to play the "welcome guest" tune. After the thirty seconds has expired, the three timed switches 62, 63, and 64 open. This stops the motor and the acoustical IC but leaves the bulb lit.

When the acoustical switch or the wall switch is again activated to turn the lamp 11 off, the variable resistor 40 dims the bulb 25. The first timed switch 62 and the second pair of timed switches 67 and 68 close to drive the motor 30 in the opposite direction, in this example, counterclockwise, to close the petals 21 around the bulb. Concurrently, a second acoustical integrated circuit 69 plays a "goodbye guest" tune. After thirty seconds, the timed switches 62, 67 and 68 open and the lamp 11 is completely deactivated. The methods of controlling the circuitry shown in FIG. 7 and the other circuitry required for the lamp are readily derivable by those of skill in the art.

From the foregoing, it will be appreciated that the pleasing means of holding a light source such as a bulb. Although the lamp is described with reference to a flower having petals that open, the lamp could also be included in other embodiments such as an animal mouth that opens to expose the bulb or an automobile hood that opens to expose the bulb. Rather than using a base as shown in the Figures, the lamp may be included in a three-dimensional painting or sculpture. In each instance, the flower petals or animal mount or hood may be silvered to reflect and intensify the light generated by the bulb. Although particular embodiments of the invention have been illustrated and described, various modifications can be made without departing from the spirit or scope of the invention.

What is claimed is:

1. A lamp comprising:
a socket supported on a base;
a bulb mounted in the socket;
means connected to the bulb for providing electrical power to the bulb through the socket;
a switch for connecting or disconnecting the power to the bulb;
fins mounted on a fulcrum;
wires attached to one end of the fins;
a shaft connected to the wires;
means for longitudinally driving the shaft to cause the wires to pull on the fins and conceal the bulb when the power to the bulb is disconnected or to release the tension on the wires and permit the fins to rotate about the fulcrum and expose the bulb when the power to the bulb is connected;

means for gradually dimming the bulb when the power is disconnected from the bulb;

means for gradually brightening the bulb when the power is connected to the bulb; and means for generating sound in response to the switch connecting or disconnecting the power to the bulb.

2. The lamp of claim 1 wherein the means for longitudinally driving the shaft comprises:

a motor having a rotatably driveable output;

a screw connected to the output of the motor and to the shaft connected to the wires; and means for activating the motor to rotate the screw in a first direction to longitudinally drive the shaft in a first direction and for activating the motor to rotate the screw in a second direction to longitudinally drive the shaft in a second direction.

3. The lamp of claim 1 wherein the means for longitudinally driving the shaft comprises:

a motor having a rotatable output;

an ellipsoid cam connected to the output;

a lifter attached to the shaft and driveably abutting the cam; and means for activating the motor to rotate the cam and thereby longitudinally drive the lifter and shaft.

4. The lamp of claim 1 wherein the means for longitudinally driving, the shaft comprises:

a motor having a rotatably driveable output;

a toothed gear attached to the output;

a rack affixed to the end of the shaft and having teeth intermeshed with the teeth on the gear; and means for activating the motor to rotate the gear in a first direction and thereby drive the rack in a first longitudinal direction and for activating the motor to rotate the gear in a second direction and thereby drive the rack in a second longitudinal direction.

5. A lamp comprising:

a socket supported on a base;

a bulb mounted in the socket;

mean connected to the bulb for providing electrical power to the bulb through the socket;

a switch for connecting or disconnecting the power to the bulb;

means for gradually concealing the bulb when the power to the bulb is disconnected and for gradually exposing the bulb when the power to the bulb is connected;

means for gradually dimming the bulb when the power is disconnected from the bulb;

means for gradually brightening the bulb when the power is connected to the bulb; and means for generating sound in response to the switch connecting or disconnecting the power to the bulb.

6. The lamp of claim 5 wherein the means for concealing the bulb comprises:

fins mounted on a fulcrum;

wires attached to one end of the fins;

a shaft connected to the wires;

means for longitudinally driving the shaft to cause the wires to pull on the fins and conceal the bulb or to release the tension on the wires and permit the fins to rotate about the fulcrum and expose the bulb.

7. The lamp of claim 6 wherein the means for longitudinally driving the shaft comprises:

a motor having a rotatably driveable output;

a screw connected to the output of the motor and to the shaft connected to the wires; and means for activating the motor to rotate the screw in a first direction to longitudinally drive the shaft in a first direction and for activating the motor to rotate the screw in a second direction to longitudinally drive the shaft in a second direction.

8. The lamp of claim 6 wherein the means for longitudinally driving the shaft comprises:

a motor having a rotatable output;

an ellipsoid cam connected to the output;

a lifter attached to the shaft and driveably abutting the cam; and means for activating the motor to rotate the cam and thereby longitudinally drive the lifter and shaft.

9. The lamp of claim 6 wherein the means for longitudinally driving the shaft comprises:

a motor having a rotatably driveable output;

a toothed gear attached to the output;

a rack affixed to the end of the shaft and having teeth intermeshed with the teeth on the gear; and means for activating the motor to rotate the gear in a first direction and thereby drive the rack in a first longitudinal direction and for activating the motor to rotate the gear in a second direction and thereby drive the rack in a second longitudinal direction.

10. A lamp comprising:

a bulb;

means connected to the bulb for providing electrical power to the bulb;

a switch for connecting or disconnecting the power to the bulb;

pivotally mounted means for gradually exposing the bulb when the power to the bulb is connected and for gradually concealing the bulb when the power to the bulb is disconnected means driven by an electric motor for pivotally operating said means for gradually exposing the bulb.

11. The lamp of claim 10 further comprising:

means for gradually dimming the bulb when the power is disconnected from the bulb; and means for gradually brightening the bulb when the power is connected to the bulb.

12. The lamp of claim 10 further comprising means for generating sound in response to the switch connecting or disconnecting the power to the bulb.

13. The lamp of claim 10 wherein the means for concealing the bulb comprises:

fins mounted on a fulcrum;

wires attached to one end of the fins;

a shaft connected to the wires;

means for longitudinally driving the shaft to cause the wires to pull on the fins and conceal the bulb or to release the tension on the wires and permit the fins to rotate about the fulcrum and expose the bulb.

14. The lamp of claim 13 wherein the means for longitudinally driving the shaft comprises:

a motor having a rotatably driveable output;

a screw connected to the output of the motor and to the shaft connected to the wires; and means for activating the motor to rotate the screw in a first direction to longitudinally drive the shaft in a first direction and for activating the motor to rotate the screw in a second direction to longitudinally drive the shaft in a second direction.

15. The lamp of claim 13 wherein the means for longitudinally driving the shaft comprises:

a motor having a rotatable output an ellipsoid cam connected to the output;

a lifter attached to the shaft and driveably abutting the cam; and means for activating the motor to rotate the cam and thereby longitudinally drive the lifter and shaft.

16. The lamp of claim 13 wherein the means for longitudinally driving the shaft comprises:

a motor having a rotatably driveable output;

a toothed gear attached to the output;

a rack affixed to the end of the shaft and having teeth intermeshed with the teeth on the gear; and means for activating the motor to rotate the gear in a first direction and thereby drive the rack in a first longitudinal direction and for activating the motor to rotate the gear in a second direction and thereby drive the rack in a second longitudinal direction.

* * * * *